United States Patent [19]

Cole et al.

[11] 4,028,099

[45] June 7, 1977

[54] CONTINUOUS STREAM - INCLINED TROUGH TREATMENT OF DUCTILE IRON

[75] Inventors: Gerald S. Cole, Dearborn; Bela V. Kovacs; Robert A. Sensoli, both of Dearborn Heights; Herschel B. Smartt, Plymouth, all of Mich.

[73] Assignee: Ford Motor Company, Dearborn, Mich.

[22] Filed: Apr. 17, 1975

[21] Appl. No.: 569,029

[52] U.S. Cl. ..... 75/130 B; 75/130 A; 75/130 BB; 148/35; 75/123 CB

[51] Int. Cl.[2] ..... C22C 33/08; C22C 33/00

[58] Field of Search ..... 75/130 A, 123 CB, 130 B, 75/130 BB, 130 C, 34 T, 130 R, 13 AB; 266/34 PT, 34 T; 148/35; 164/55, 56, 66, 57

[56] References Cited

UNITED STATES PATENTS

| | | | |
|---|---|---|---|
| 2,677,609 | 5/1954 | Moore et al. | 75/130 B |
| 2,867,555 | 1/1959 | Curry | 75/123 CB |
| 3,193,383 | 7/1965 | Butler | 75/123 CB |
| 3,545,960 | 12/1970 | McClellan et al. | 75/130 B |

*Primary Examiner*—Walter R. Satterfield
*Attorney, Agent, or Firm*—Joseph W. Malleck; Keith L. Zerschling

[57] ABSTRACT

A method and apparatus for producing modified grey iron, and particularly nodular cast iron, is disclosed. The apparatus comprises refractory elements including an inclined flow course for continuous reception of molten grey iron, a V-shaped inclined receptacle interposed in said course into which a predetermined supply of modifying agent, such as magnesium, is injected to react with said iron, and means for controlling the egress of iron from the receptacle in order to sequentially stage the build-up and dissipation of a pool of iron in said receptacle facilitating chemical reactions and thorough mixing for attaining and improving the homogeneity of the modified iron elements. The product and compositon uniquely is characterized by about 3.5 carbon, by weight, 2.5% silicon, 0.2–0.9% Mn sulfur no greater than 0.015%, the remainder being essentially iron; the composition is devoid of carbide and dross or slag and has a graphite nodule count of at least 400 per square millimeter in a ½ inch section.

14 Claims, 7 Drawing Figures

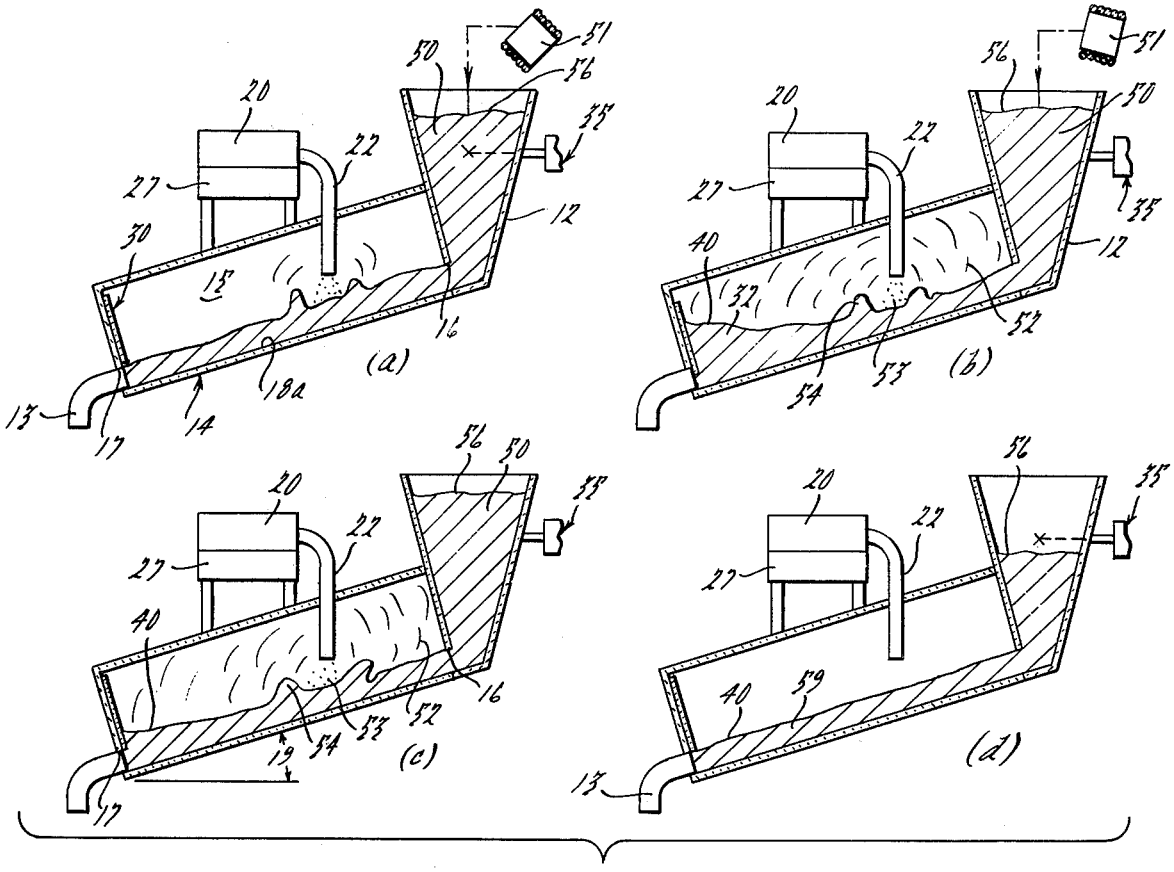
FIG. 4.
FIG. 5.
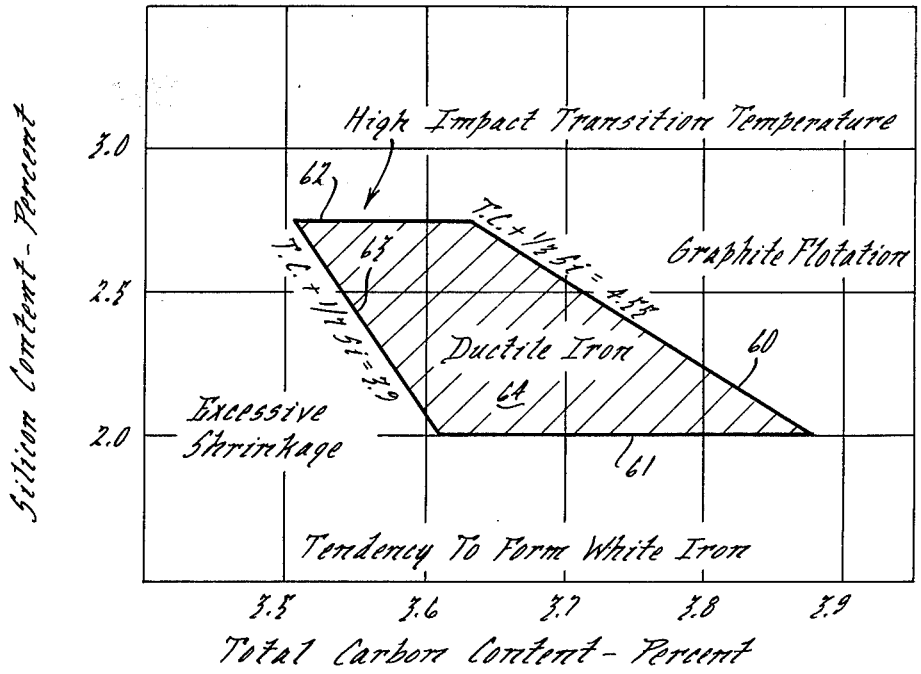

CONTINUOUS STREAM - INCLINED TROUGH TREATMENT OF DUCTILE IRON

BACKGROUND OF THE INVENTION

The general process for modifying iron, and in particular producing nodular cast iron, (i.e., cast iron comprising nodular or spheroidal graphitic inclusions) comprises in its broadest aspect supplying to molten grey iron a relatively minor amount of magnesium (based on the weight of the cast iron to be treated). Such magnesium additions preferentially lowers the sulfur and oxygen content of molten cast iron compositions, and, if sufficient magnesium is added, such treatment has the effect of producing spheroidal graphite rather than a flake graphite form.

Considerable problems have been associated with the introduction of elemental magnesium to a bath or exposed stream of molten iron. Ladle additions of magnesium to a molten iron bath have been largely avoided because the comparatively low boiling point of magnesium and its high degree of reactivity with oxygen and low density (relative to the density of the molten cast iron) causes substantial and expensive magnesium losses resulting from flash off at the surface of the molten bath. The loss is usually indicated by a violent pyrotechnic display and is accompanied by a violent reaction causing splashing of molten iron; this latter factor, along with the pyrotechnic display, constitute a serious threat to the welfare of personnel and equipment, especially in commercial operations wherein the amount of iron is to be treated and the amount of magnesium metal required is generally great.

Efforts to reduce pyrotechnics and splashing have usually comprised adding the nodularizing agent to an enclosed treating ladle or enclosed reservoir stationed in the mold and through which the metal must ultimately flow. A modification to the ladle addition approach has used a tubular device to introduce solid addition agents, such as magnesium, below the surface of the molten metal; the magnesium is added in the form of a fine grain suspension in a gaseous carrier. Similar to this approach is the sub-surface injection of a mixture of powdered carbon and elemental magnesium, or the use of a tiltable reaction ladle with magnesium stored in one region thereof and caused to react under a certain vapor pressure. A commercial ladle approach, is the dropping of powdered additives of magnesium through a chute that enters a conical cavity in a stream of molten iron flowing through an aperture in the bottom of a storage chamber for molten metal; this is commonly referred to as the T-nock process. There is a vast number of other published arrangements for introducing magnesium during the pouring of molten iron into a ladle or while it is in the ladle.

In all of the above enclosed pouring ladle approaches, the results are unsatisfactory because of essentailly three problems, the most important of which is that the metal must be superheated to accommodate the considerable loss in heat from reladling and pouring. The superheat destroys growth sites and thus requires post inoculation to improve the distribution of the graphite nodules; inoculation has never achieved totally satisfactory homogeneity and magnesium recovery is relatively low leading to high costs.

The other two problems comprise dross build-up in the pouring vessel and the fading of the reacted magnesium before solidification. Dross on the ladle refractories create magnesium reaction products (sulfides, oxides); this can lead to excessive pouring unit downtime as a result of inductor channel clogging, loss of vessel volume, and pouring orifice restrictions. Magnesium and post inoculant fade are time dependent phenomenon. In general, the iron must be poured within 15 minutes of the time of treatment. If this cannot be done and if corrective actions are not taken, low nodularity of carbidic castings are likely to result.

Thus the prior art has turned to treating the molten iron after it leaves the mechanical pouring unit or ladle. One general approach to this post treatment is that which treats the molten metal as it flows through the casting mold or just prior to its entrance into the mold cavity. A notable example of stream treatment employs a reaction chamber embedded in the sand mold, thus forming a part of the runner system. A charge of magnesium bearing material is added to the reaction chamber in advance of pouring. Nodularization is accomplished by the reaction of this magnesium bearing material with the molten metal flowing through the reaction chamber. Several disadvantages are associated with this process including increased casting inspection, the ratio of the poured weight of metal to the cleaned weight of metal increases, there must be closer metallurgical control, an investment in unique runner and gating systems, and usually a closely sized magnesium ferrosilicon alloy is required since the molten metal has a difficult time in flowing around each magnesium particle. As to the increased casting inspection, this becomes a significant disadvantage. Each mold is treated individually. The conventional method of checking each treated quantity of metal for nodularizing content and for chill is impractical. A fail safe method of adding the magnesium alloy and of checking the produced castings has yet to be developed to make this approach successful.

Earlier attempts at stream treatment used a filter element placed at the mouth of this mold gating system; the filter had a predetermined porous magnesium matrix through which the molten iron was poured. Alternately, a consumable pouring sprue containing sponge iron impregnated with magnesium, both of which were reacted at a predetermined rate of consumption. In still another approach, an exposed stream was poured into a mold and an exposed stream of magnesium additive was projected against the stream for mixing and chemical reaction. These earlier attempts at stream treatment were, of course, unsatisfactory because they did not provide a controlled rate of solution; this is a function of alloy form and composition, treatment temperature, system heat, type and time of exposure to iron (the solvent) and oxygen available.

Whether the commercial practice has been stream treatment or ladle treatment, it has been carried out in batches; typically, up to several tons of molten iron is nodularized in a treating or holding ladle, then reladled into several pouring ladles, and then finally poured into a mold with post inoculating agents added to the pouring stream during transfer from treating ladle to the pouring ladle.

SUMMARY OF THE INVENTION

The primary object of this invention is to provide an improved method and apparatus, as well as the resulting product, for treating and manufacturing nodular cast iron, all characterized by better process control, lessened quality efforts (as judged by the uniformity of the resulting product) and lower material costs.

Another object of this invention is to provide a method and apparatus for nodularizing cast iron which is relatively independent of time variations for treating the molten iron.

Still another object is to provide a method of modifying cast iron which utilizes a constant predetermined pour rate and facilitates automatic continuous pouring requiring little or no operator control.

Particular features pursuant to the above objects comprise: (a) the use of an inclined trough having the aperture of an outlet controllable to selectively develop a pool of molten iron without interrupting flow therethrough, a modifying agent is injected into the pool and/or stream to provide turbulant flow and mixing as a result of the chemical reaction and time dwell therein; (b) the pool is built-up and dissipated in stages to provide for an initial quick fill and a trailing flushing flow; (c) the modifying agent may include a postinoculant or a desulphurizing material, such as magnesium ferrosilicon, effective to carry out a significant desulphurization simultaneous with nodularization; (d) the superheat temperature of the treated molten stream is considerably lower (about 100°–150° F.) than prior art methods; (e) the refractory chamber is effective to reduce gaseous emissions from the nodularization treatment significantly, thereby minimizing the need for special anti-pollution equipment; (f) since the stream treating equipment is small and exterior to the mold, it can be changed to treat a variety of different sized streams at different rates and back-to-back by merely changing either the reaction chamber or changing the pouring cup and exit openings, such choice depending on the design of the particular system; (g) the treated stream is directed immediately to a mold cavity and preferably a plurality of flasks containing a number of mold cavities, at a constant time factor; and (h) the resulting cast product is characterized by a unique absence of carbides and dross, and has a nodule distribution count of at least 400 per square millimeter in a ½ inch section.

SUMMARY OF THE DRAWINGS

FIG. 4 is a composite of views depicting steps in the control of a pool of molten iron within a reaction chamber through which the stream flows;

FIG. 5 is a graphical illustration of the preferred range of carbon and silicon useful to characterize base iron as the starting material for this invention.

DETAILED DESCRIPTION

APPARATUS

Figure 1:
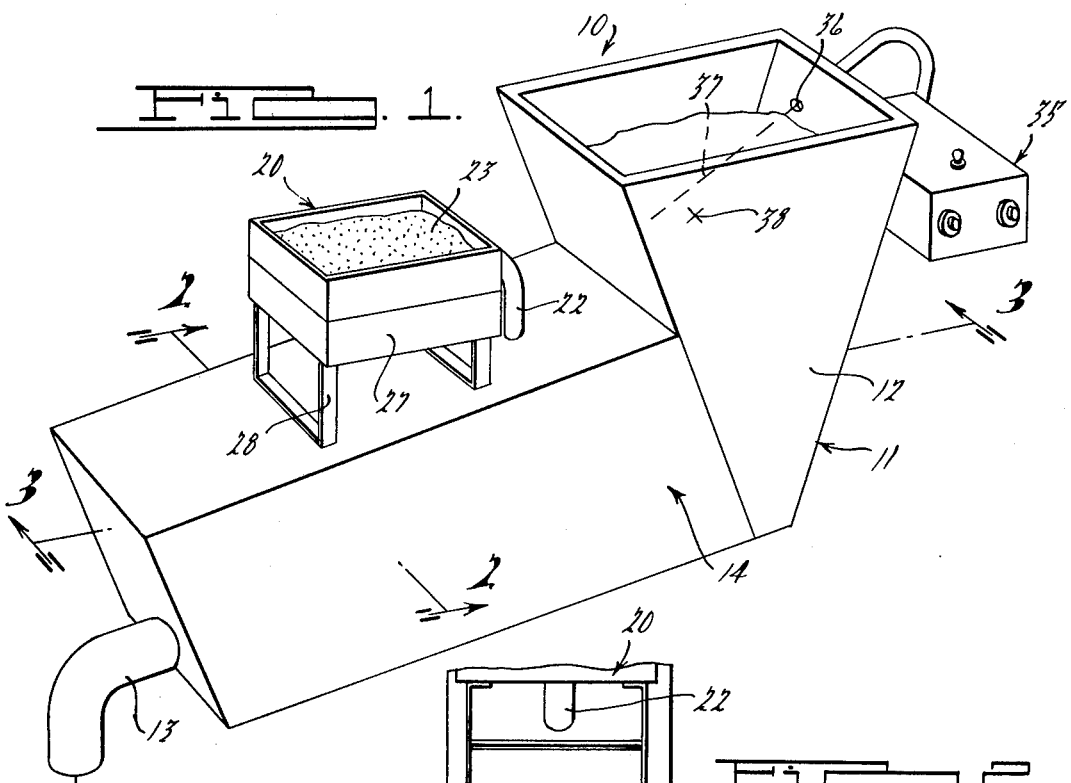
FIG. 1 is a perspective view of an apparatus embodying the principality of this invention for stream treating molten iron.
Figure 2:
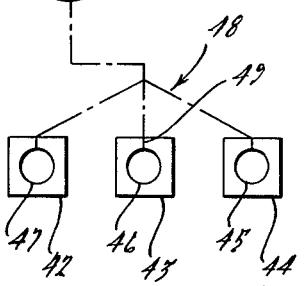
FIGS. 2 and 3 are each substantially sectional views taken, respectively, along lines 2—2 and 3—3 of FIG. 1.
Figure 2:
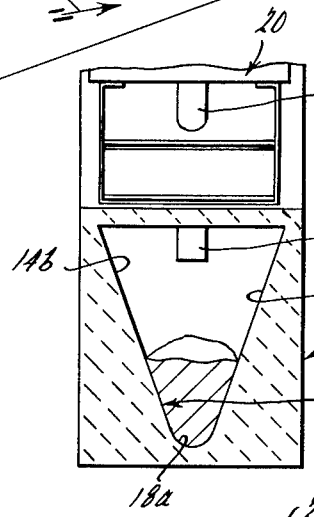
Figure 3:
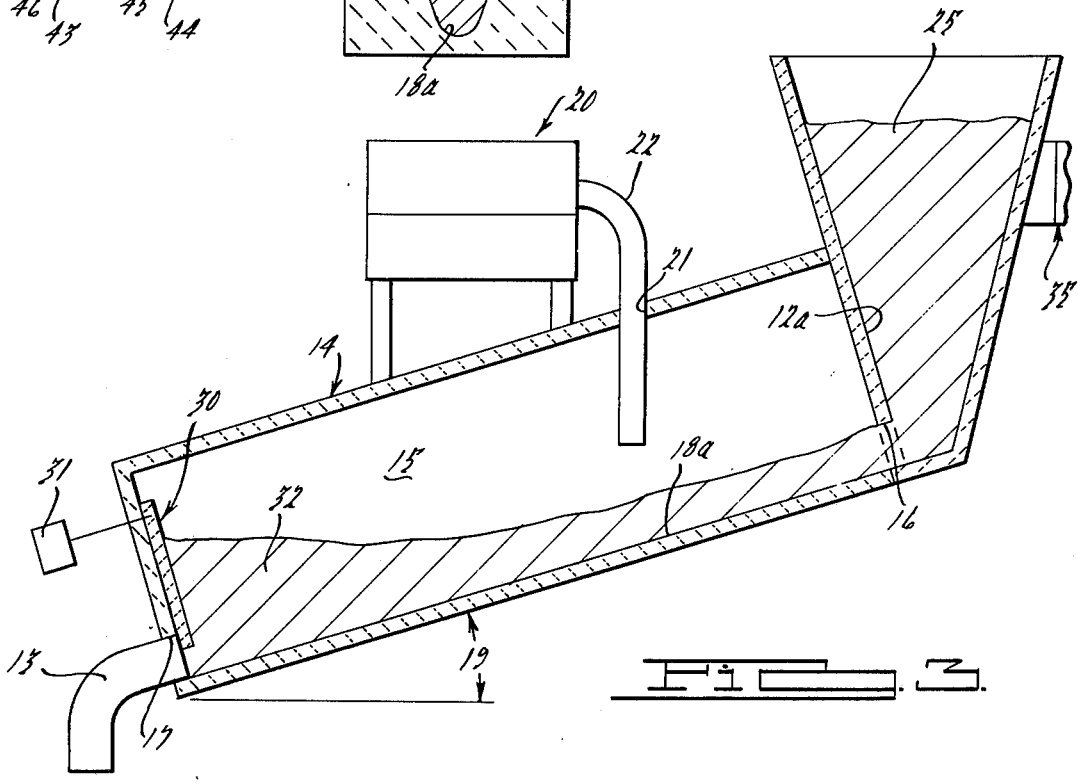

Turning first to FIGS. 1–3, there is depicted an apparatus which is particularly effective in carrying out the method of this invention and which contains novel structural features for stream treatment of molten iron. The apparatus 10 comprises means 11 defining an inclined flow course of refractory elements to conduct and define a stream of molten iron. The course consists of a receiving cup or basin 12 and a conduit 13; the cup has tapered interior walls **12*a* arranged to receive a predetermined continuous input or discrete charge of molten iron 25. The cup has an outlet opening 16 located at the lower most region which also serves as the inlet to adjoining structure; the size of opening 16 may effectively determine the maximum flow rate through the course but more predominantly the controlled outlet aperture of treating chamber will serve this function, as will be described. In place of the receiving cup, another conduit may be substituted to receive the iron. In any event, the inclined flow course is capable of delivering a stream of iron along a path at a predetermined flow rate influenced principally by gravity; the flow rate is changeable by primarily changing the size of opening 17 which may entail substituting a different cup 12 having a different sized opening 16** and/or adjusting the incline of the adjoining structure.

A refractory lined receptacle 14 is interposed in said flow course and has a closed interior reaction or expansion chamber 15; the receptacle has an open side abutting cup 12 in a sealing manner and utilizes opening 16 as an inlet. The receptacle 14 has an outlet 17 connecting with said conduit 13 and provides for egress of molten iron. Interior side walls **14*a* and 14*b* of the receptacle are inclined with respect to a central bifurcating plane; the walls 14*a* and 14*b* form a trough 18 substantially along the entire length of said receptacle and have bottom 18*a* of the trough inclined at an angle 19** with respect to a horizontal plane.

An apparatus means 20 is arranged atop the receptacle 14 for injecting a predetermined and continuous supply of modifying agent 53 into the chamber 15 of said receptacle by way of a conduit 22 extending through an opening 21 in the receptacle roof. Means 20 may be comprised of any suitable control apparatus, such as a vibrator 27 supported on structure 28 and effective to deliver a predetermined quantity of particulate material, preferably in the form of sized pellets, from a bin containing a supply 23 of said pellets.

The outlet 17 is controllable by means 30, which may take the form of a slidable gate operable by a suitable mechanical or electronic element 31. There must be at least one aperture control for either of said inlet or outlet (17 or 18). By adjusting the position of said gate relative to the opening 17, a pool 32 of molten iron may be built-up or dissipated in said chamber 15. The apertures of openings 16 and 17 are preferably designed to be of generally equal area and thus, when unobstructed, a maximum fast flow with a minimum diameter stream can be expected through chamber 15. By traversing the gate across opening 17, a differential between said apertures may be established promoting the development of said pool and in effect daming a portion of the flow therethrough.

The function of the slidable gate is twofold; (a) it must contact the stream surface to prevent the modification agent from floating out of the reaction chamber, (b) restrain the stream flow to increase residing time in the chamber. It is conceivable that if a series of gates are arranged to skim and control flow in a highly elongated chamber, the need for a pool becomes less critical.

An optical control 35 is employed to regulate the operation of injector means 20; control 35 has an optical sensor 36 aimed along a sensing path 37 to detect the presence of molten iron in said cup 12 at about a station 38. Station 38 should be adjacent the upper portion of said cup and remote from the trough 18. The control 35 is connected and arranged to electrically activate or deactivate vibrator 27 which in turn establishes the introduction of the modifying agent. When or if the charge of molten metal recedes below the station 38, the control 35, of course, deactivates the vibrator 27 and thereby stops any further injection of the modifying agent. Thus, the terminal portion of said flow residing between said receptacle 14 and station 38 will not receive direct injection of the modifying agent but will be chemically reacted by virtue of mixing with the residual iron in the flow course or in the pool 32.

The reacted molten metal is immediately directed by means 48 from conduit 13 to a plurality of molding flasks (42, 43, 44) each containing a molding cavity (45, 46, 47) for solidifying the casting. No special runner or gating system 49 is required in the molding setup and the entire apparatus may be operated by automatic pouring equipment (not shown). Highly controlled and automated operation is not possible on a continuous basis with apparatus or methods known to the art and yet achieve the cost savings and quality castings of this invention.

METHOD

A preferred method aspect of this invention is as follows:

a. A charge of base iron, having a chemistry equivalent to grey cast iron, is heated to a temperature in the range of 2500°–2700° F. Ductile or grey iron of one type considered pertinent to the present method can best be defined as that having carbon and silicon within the shaded area of the graph of FIG. 5. This type of composition of grey iron should have essentially between 3.5 and 3.7% by weight, total carbon and between 2.0 and 2.75 silicon (but as much as 3.0% ). Variable end limits between these ranges, depicted by lines 61 and 62, are best defined by lines 60 and 63. Line 60 is the result of the equation where total carbon plus ⅓ silicon equals 4.55; line 63 is the result of the equation where total carbon plus 1/7 silicon is equal to 3.9. However, certain iron types may be used which have a chemistry employing a greater silicon content; thus, the problems noted on the graph of FIG. 5 are only for the iron type there selected.

b. An inclined flow course is provided; an inclined trough is interposed in the flow course having an inlet and an outlet for the trough disposed at the lower most apex of the trough and interconnecting with the flow course. The course is enclosed and particularly the trough is enclosed so that any gaseous emissions are trapped eliminating need for special anti-pollution equipment. For example, magnesium vapor will be released and will quickly condense on the tapered walls of the trough. The inlet and outlet can be arranged to have equal areas or apertures, one of which is controllable in size by way of a slidable gate thereacross; more preferably, the outlet can be sized somewhat smaller. As shown in FIG. 3, it has been deemed preferable to control the aperture of the outlet to provide a differential between the amount of flow making an ingress as compared to the flow making an egress from the trough. The length of the trough for the preferred embodiment should be about 30 inches, and the volume of the trough (defined by inclined side walls) should provide for expansion of the molten iron when reacted with a modifying agent. Such volume can be about one-third cubic foot. To insure a proper flow rate of the molten iron through said trough, it is inclined at an angle 19 which preferably is about 5° with respect to a horizontal plane. This incline, of course, is designed with the molten iron flow under no back pressure other than that which is produced by the column of molten iron in the receiving cup 12. If additional back pressure is provided, the incline and flow rate can be adjusted accordingly. In addition, a non-oxidizing atmosphere is preferably maintained within the flow course to prevent any unwanted oxidation of the molten iron.

c. A stream of molten ductile iron is established and passed along said incline course and through said trough; the stream is controlled to have a flow rate of typically about 10 lbs. of molten iron per second which conforms to manufacturing reality, although a more preferable flow rate would be about 5 lbs. per second.

d. As the molten grey iron passes through said trough, a modifying agent, preferably in the form of magnesium ferrosilicon operative as a nodularizing agent, is injected at a predetermined rate onto the stream for reaction therewith. A vibrating mechanism which may be used when the agent is in a particulate or lump form; the agent 53 will be urged to spill onto and through a feeding conduit 22 for deposit at a location on the stream in the upper region of the trough. For magnesium ferrosilicon, it is added at a rate and in an amount to achieve approximately 0.04–0.055% magnesium in the final casting; 0.0004–0.0006 lbs. (0.18–0.25 grams) of magnesium is dissolved for each pound of molten iron. Magnesium, being the critical modifying agent, can be introduced in other forms such as by a solid magnesium rod advanced so that the tip thereof progressively contacts the molten stream, or the magnesium may be added in the form of pure vapor. When the magnesium in particulate compound form, it is important that the lump size not be too great so as to prevent a graduated and controlled feed and should not be too small as to prevent good reaction with the molten stream; the minimum size should not be less than 750 microns.

e. One of the main features of this invention is the flexibility of adjusting the injection rate of the modifying agent so as to match the flow rate of the stream passing through the reaction chamber of the trough and to adjust the pouring rate to fill the mold cavities at a required interval. Accordingly, the flow through said trough or reaction chamber is adjusted to provide a staged build-up and dissipating of a pool therein of sufficient quantity to provide for turbulency and thorough mixing of the modifying agent. Improved dissolvement of the agent in the molten iron is established so that at least 90% of the magnesium is recovered in the casting.

Referring to FIG. 4, the initial stage (a) permits the molten iron supplied to the receiving cup 12 from a heating ladle or furnace 51 to flow through the chamber 15 at a fast rate with no pool build-up; gate 30 is raised so that the inlet and outlet 17 apertures being maintained at generally equal size. The injection means 20 is triggered to introduce the modifying agent 53 simultaneous with the introduction of molten iron 50 to the receiving cup as sensed by the photoelectric means 35. Accordingly, the nodularizing agent, in the form of magnesium ferrosilicon pellets will be released to contact the earliest portions of the stream. However, since there is fast flow and little dwell time within the trough, total nodularization or reaction of the modifying agent and the iron will not take place in the trough. Nonetheless, the iron must migrate through the runner and gating system before reaching the mold cavity; in so doing it has been predetermined that the initial flow of the stream will totally reach outside the trough but prior to entry into the mold cavity. (b) As soon as the gate 30 can be progressively lowered to restrict the outlet 17, a pool 32 of molten iron is established in the trough which should have a sufficient depth to allow thorough reaction and turbulency 54 of the molten iron therein. This may preferably be at least 3 times the normal dimension of the stream flow. The top surface 40 of the molten pool will be built-up to such an extent that it may reach to the roof of the enclosed chamber. The entire surface of the pool will not be calm and smooth during the injecting phase of treatment since the contact of the magnesium therewith will result in immediate pyrotechnics and reactions rendering the evolution of gases 52. (c) In this stage, the gate 30 is progressively raised to cause the pool to dissipate even though further molten iron is maintained in the reception cup and even though the modifying agent is continued to be injected. The same reactions and evolution of gases, of course, continue to take place with slightly less mixing due to the receding pool. However, this stage is arranged so that it will be close to the trailing end of the charge or stream even though the surface 56 of the charge is still above the sensor 35. The pool is caused to dissipate as quickly as possible. (d) Finally, in this stage, the pool has been fully dissipated; the inlet and outlet are maintained at identical apertures or their full uncovered aperture thereby causing a rapid flow 59 straight through the trough. This occurs almost simultaneous with the receding of the molten iron in the reception cup below that at which the optical eye is trained, causing the injection of the modifying agent to be stopped. Thus, the trailing end of the stream flows through the trough without contact by additional injection of the modifying agent. However, since the very trailing end of the stream will fundamentally be solidified in the gating system of the mold arrangement, the unreacted or poorly reacted iron will be discarded. The rapid flow in this stage is important since it allows for flushing of the trough carrying away any impurities or slag that are retained on the surface of the pool, such impurities solidifying in the runner or gating system.

f. The reacted stream is directed into a plurality of flasks (42, 43, 44) each containing preferably a tree-like arrangement of numerous castings interconnected by runner and gating systems in each mold. The plurality of flasks are arranged as close as possible to the reaction chamber or trough so that the dwell time, once the magnesium has reacted with the ductile iron, is limited to less than 5 seconds. The actual flow rate into each of the molds, of course, will be variable to some degree as dictated by the type of runner and gating system and the number of molds utilized. Nonetheless, this invention permits unprecedented, quick control of reaction and casting. If the dwell time between reaction and solidification is excessive, the nodularizing effect of magnesium will diminish causing a substantial nodule degeneration in the eventual casting.

Unprecendented cost reductions result from this continuous nodularization method for cast iron. With older techniques of nodularizing in a pouring ladle, several disadvantages resulted. Superheating was required which lead to a reduction in the number of growth sites for subsequent nodularization; post inoculation was thereby required to impove the distribution and homogeneity of the nodular cast iron, all of this resulting in higher costs. When the prior art turned to reacting magnesium in an enclosed chamber within the mold itself, a very important disadvantage resulted. There was complete lack of control or monitoring of the unviewable chamber; operators could never be quite confident that every portion of the iron charge was nodularized. Operators thus used excessive amounts of nodularizing agent to provide a margin of saftey and this again, of course, resulted in additional cost increases. The elimination of any baghouse or emission control equipment is an important advantage of the instant system. The need for special runners or gating is eliminated, such as that required in a system where the reaction chamber is enclosed in the molding flask.

The present inventive method is preferably operated with a low sulfur content in the iron charge 0.01–0.015%). However, this system is uniquely adaptable to disulfurization, to a limited degree, in the reaction chamber. Accordingly, additional desulfurizing agents may be added along with the magnesium to obtain a sulfur content of less than 0.01%. The ability to desulfurize in a local reaction chamber, immediately upstream of the mold, is unknown to the art and can lead to further significant cast reduction in the total iron treating method.

SAMPLES

Initial experimental research tests demonstrated the importance of the control of the molten flow through an inclined trough and the importance of the pool volume with respect to obtaining a full nodularizing action in stream treatment.

In a first research sample, the trough was arranged to have no pool build-up during treatment; the flow through the inlet and outlet of the trough was relatively rapid. Starting materials comprised for 42 lbs. of pig iron, 7 lbs. of pure iron, 500 grams of ferrosilicon, 160 grams of ferro manganese and 210 grams of magnesium ferrosilicon (Mg was 6% of additive). The pour temperature was 2650° F and a nitrogen atmosphere was contained in the reaction chamber. Vibrator action was maintained for four seconds during the pour. The castings showed very good nodularization when analyzed at the middle of the pour (taken from the outlet of the chamber). However, when analyzed at initial stage of the pour, the nodularity was very poor due to inadequate reaction.

In a second research sample, the treating system was arranged to fill a plurality of molds, carried on a long cart, rolled under the outlet of the reaction chamber. Again, there was no pool build-up during stream treatment. The starting materials for the treatment included 58.2 lbs. of pig iron, 10 lbs. of pure iron, 714 grams of ferrosilicon, 228 grams of ferro manganese, and 300 grams of magnesium ferrosilicon (Mg was 6% of additive). The vibrator was operated over a 7 second interval which provided for more adequate addition of the modifying agents. The first mold poured showed pour nodularity due to inadequate magnesium reaction, there being no build-up of a pool in the trough of the treating chamber. The second casting in the second flask showed fair to good nodularity but exhibited an inserve chill. The last casting showed excellent nodularity.

A third research sample was arranged to provide a shallow pool in the treating chamber. Starting materials were similar to that in the second sample. The pour temperature was 2680° F., there was no nitrogen contained in the reaction chamber, and pouring time took 10 seconds. The castings showed only 30% nodularity, indicating that some of the reaction between the magnesium and iron took place outside the treating chamber. Part of the problem of this particular sample arose from the inadequate location of an optical power cell to begin and stop the addition of the modifying agent.

A fourth research sample was made with starting materials similar to that in the second sample except that the magnesium ferrosilicon was adjusted to provide 5% magnesium and about 0.5 Ce in the additions. Pouring temperature was 2660° F. and the pouring time took 16 seconds. A significant and deep pool was built-up in the treating trough. The nodularity of the casting was excellent and nearly 100%. The optical power cell was aimed at a different location to insure that the injection of the modifying agent was more appropriately timed with the flow of iron through the trough; the trailing portion of the stream through the trough was not accompanied by simultaneous injection causing residual reaction of the magnesium in the pool to complete a nodularizing reaction for the trailing portion.

PRODUCT

Figure 6:
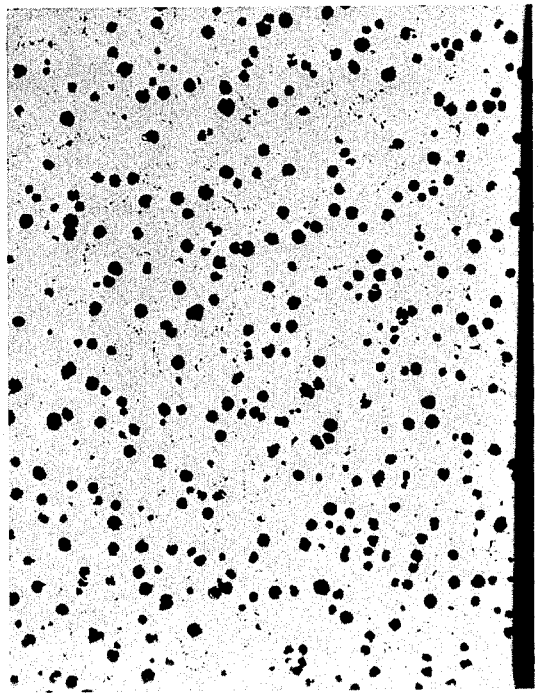
FIGS. 6 and 7 are microphotographs, respectively 100× and 50× of the solidification structure of castings resulting from the practice of this invention.
Figure 7:
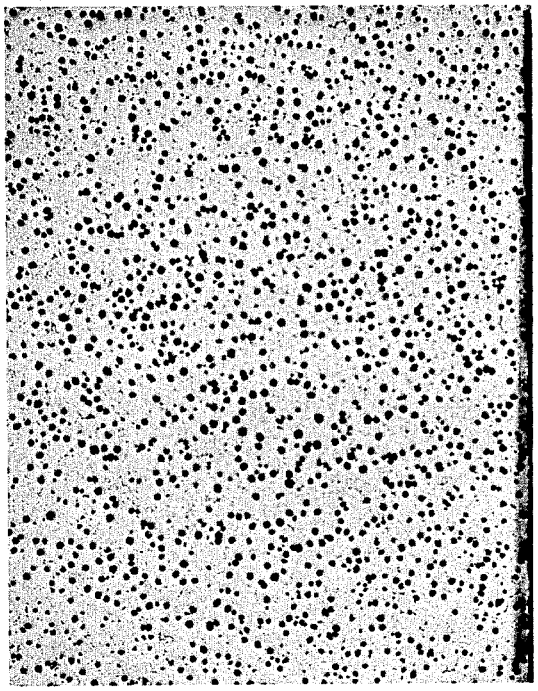

Utilizing the stream treatment development taught herein, a new product is created having a solidification structure as illustrated in FIGS. 6 and 7. The casting microstructure is characterized by a nodular distribution at a count of at least 400 per square millimeter for a ½ inch section, the nodules can be and are predominately of the type I shape (spherical) by at least 90%, and there is a high degree of homogeneity. There is a definite and observable absence of dross or slag in the microstructure and a definite absence of carbides. The chemistry of the casting accompanying such microstructure consists essentially of about 3.5 carbon, 2½% silicon, the ratio between carbon and silicon being about 7:5 the sulfur content being less than 0.01%, about 0.6 Mn, and the remainder being substantially iron. The magnesium content of the nodularized cast iron is about 0.004.

A zoned casting can be made from a single pour according to this invention. This is facilitated by the ability to control the stream treatment of the molten iron so that a predetermined portion may be nodularized and a predetermined portion not nodularized. Accordingly, a casting may be provided which has a specific volume, such as a head or a hub of a casting, containing nodularized cast iron with the remaining volume of the casting being of ductile or grey cast iron depending on the application and design.

We claim as our invention:

1. A method of producing treated iron, comprising:

a. providing an inclined and enclosed course through which a molten stream of treatable iron may flow, said enclosed course having an expansion chamber interposed therein with an inlet and an outlet respectively connecting said course to said chamber while permitting said iron to flow therethrough, at least one of said inlet or outlet being controllable in aperture size, said chamber having another opening into which and through which a graduated supply of treating agent may be injected to contact, react, mix and expand with said iron flow, said chamber being comprised of refractory material substantially unreactive with the iron flow or agent and said chamber being maintained in a gas-tight condition, said course further being arranged so that the outflow from said expansion chamber is directed immediately to a mold solidifying said treated iron substantially independent of time and temperature variations, b. introducing a predetermined quantity of molten treatable iron to said course in a manner to flow into and through said chamber, said treatable iron having a sulfur content in the range of 0.01–0.015% by weight of the predetermined quantity of iron, c. simultaneous with flow through said chamber, injecting a predetermined and continuous supply of treating agent through said another opening, said treating agent being a modifier selected from the group consisting of a rod of solid magnesium, magnesium ferro-silicon in the form of either lumps or pellets and magnesium vapor, and d. adjusting the aperture of said controllable inlet or outlet so that a predetermined collection of iron is developed and maintained in said chamber for a substantial portion of said iron flow therethrough whereby reaction between said agent and iron can create turbulence to promote further reaction and uniform distribution of products of said iron treatment.

2. The method as in claim 1, in which the adjustment of said aperture of said controllable inlet or outlet is sequentially staged to provide the following stages: (1) initially and for a short duration, the aperture of said controllable inlet or outlet is maintained substantially equal in an area to that of the non-controllable inlet or outlet, thereby providing a fast partially reacted flow through said chamber, (2) for a substantial duration of said iron flow through said chamber, the controlled inlet or outlet is adjusted to create a pool in said chamber, (3) the pool is allowed to dissipate in advance of the trailing end of said flow whereby a terminal portion of said flow will be induced to be relatively fast with the aperture of said inlet or outlet being substantially equal.

3. The method as in claim 2, in which the injection of said treating agent is terminated in advance of the passage of the terminal portion of said flow of molten iron through said chamber, the interval between the termination of said injection and the passage of the terminal portion of said flow through said chamber is arranged so that the continued residual reaction of the treating agent in said reaction chamber will affect said terminal portion of said flow.

4. The method as in claim 3, in which said stoppage of injection is in advance of the dissipation of said pool.

5. The method as in claim 1, in which said agent comprises ferrosilicon and is effective to produce additional graphite nucleation sites during solidification of said iron.

6. The method as in claim 5, in which said agent is added in a quantity of 0.4–1.0% by weight of the quantity of molten iron.

7. A method of making nodular cast iron, comprising:

a. heating a charge of un-nodularized or grey iron to a temperature in the range of 2500°–2700° F, b. passing a stream of said heated iron at said temperature through an inclined trough while continuously adding a nodularizing agent at a measured ratio to the iron flowing through said trough to provide for a reaction between said iron (or impurities in said iron) and said agent, said nodularizing agent being added in the form of a pellet having a lump size not less than 750 microns, said nodularizing agent pellets being constituted of a high content of magnesium and being added in a predetermined ratio such that 0.2–0.25 grams of said magnesium will be dissolved for each pound of iron flowing through said chamber, said trough being enclosed in a manner to provide an air-tight passage of a molten iron therethrough, said inclined trough further being defined to have inclined side walls forming a transverse V-shape whereby, in conjunction with the chemical reaction between said nodularizing agent and molten iron, a self-imposed turbulence is provided to insure adequate mixing of said agent and iron without the need for any independent mechanical mixing, c. controlling the egress of said iron flow through said trough to provide a turbulent pool of molten iron therein and so limited whereby the egress temperature of said reacted iron and agent is not substantially less than 2350° F, whereby at least 90% of said nodularizing agent is reacted with said iron, and d. immediately casting said reacted iron to provide a nodular cast iron consisting essentially of about 3.5 carbon, 2.5% silicon, about 0.6 manganese, a carbon to silicon ratio of 7:5, sulfur being no greater than 0.015% and the remainder being essentially iron.

8. The method as in claim 7, in which said nodularizing agent is added in the form of magnesium vapor.

9. The product of the method of claim 7.

10. A method of continuously making a plurality of nodular cast iron bodies by use of a multiple number of casting flasks, the method comprising:

a. preparing a molten charge of untreated cast iron having a pour temperature of 2500°–2700° F, b. passing said molten iron along an inclined stream and through an enclosed expansion and reaction chamber devoid of ambient air, a nodularizing agent being injected into said chamber at a predetermined ratio to the flow of molten iron therethrough, said chamber being inclined and the ingress and egress of molten iron therethrough being controllable so as to maintain a predetermined pool of molten iron reacting with said nodularizing agent in said chamber substantially throughout the flow of said stream therethrough, and c. immediately directing the reacted flow from said chamber to several molding flasks whereby said reacted iron enters said mold cavity in each of said flasks in less than 5 seconds after reaction in said chamber.

11. The method as in claim 10, in which only the stream of iron receives a supply of said nodularizing agent in a quantity effective to produce a solidified iron having a highly homogeneous and uniformily distributed modified graphite constituents, the number of said graphite nodules being about 400 per square millimeter in a ½ inch section and the distribution of said nodules being characterized by regularity of spacing therebetween.

12. A method of making nodular cast iron, comprising:

heating a charge of un-nodularized or grey iron to a temperature in the range of 2500°–2700° F, b. passing a stream of said heated iron at said temperature through an inclined trough while continuously adding a nodularizing agent at a measured ratio to the iron flowing through said trough to provide for a reaction between said iron (or impurities in said iron) and said agent, said trough being enclosed to a chamber facilitating atmosphere control therein and to trap gaseous emissions and pyrotechnics resulting from said reaction, the atmosphere within said chamber being non-oxidizing, c. controlling the egress of said iron flow through said trough to provide a turbulent pool of molten iron therein and so limited whereby the egress temperature of said reacted iron and agent is not substantially less than 2350° F, whereby at least 90% of said nodularizing agent is reacted with said iron, and d. immediately casting said reacted iron to provide a nodular cast iron consisting essentially of about 3.5 carbon, 2.5% silicon, about 0.6 manganese, a carbon to silicon ratio of 7:5, sulfur being no greater than 0.015% and the remainder being essentially iron.

13. A method of making nodular cast iron, comprising:

a. heating a charge of un-nodularized or grey iron to a temperature in the range of 2500°–2700° F, b. passing a stream of said heated iron at said temperature through an inclined trough while continuously adding a nodularizing agent at a measured ratio to the iron flowing through said trough to provide for a reaction between said iron (or impurities in said iron) and said agent, said nodularizing agent is added in the form of a pellet smaller in dimension than the diameter of said stream and consisting essentially of magnesium ferrosilicon with magnesium constituting 4–9% by weight of the agent, c. controlling the egress of said iron flow through said trough to provide a turbulent pool of molten iron therein and so limited whereby the egress temperature of said reacted iron and agent is not substantially less than 2350° F, whereby at least 90% of said nodularizing agent is reacted with said iron, and d. immediately casting said reacted iron to provide a nodular cast iron consisting essentially of about 3.5 carbon, 2.5% silicon, about 0.6 manganese, a carbon to silicon ratio of 7:5, sulfur being no greater than 0.015% and the remainder being essentially iron.

14. The product of the method of claim 13.

* * * * *